US008512006B2

(12) United States Patent
Hunter

(10) Patent No.: US 8,512,006 B2
(45) Date of Patent: Aug. 20, 2013

(54) HYDRAULIC PUMP WITH VARIABLE FLOW AND PRESSURE AND IMPROVED OPEN-LOOP ELECTRIC CONTROL

(75) Inventor: Douglas G. Hunter, Troy, MI (US)

(73) Assignee: BorgWarner Inc., Auburn Hills, MI (US)

( * ) Notice: Subject to any disclaimer, the term of this patent is extended or adjusted under 35 U.S.C. 154(b) by 829 days.

(21) Appl. No.: 12/597,790

(22) PCT Filed: May 2, 2008

(86) PCT No.: PCT/US2008/005631

§ 371 (c)(1), (2), (4) Date: Oct. 27, 2009

(87) PCT Pub. No.: WO2008/137037

PCT Pub. Date: Nov. 13, 2008

(65) Prior Publication Data

US 2010/0139611 A1 Jun. 10, 2010

Related U.S. Application Data

(60) Provisional application No. 60/927,651, filed on May 4, 2007.

(51) Int. Cl.
*F04B 49/00* (2006.01)

(52) U.S. Cl.
USPC ..... 417/212; 417/220; 417/219; 417/213; 418/30; 418/31; 418/26

(58) Field of Classification Search
USPC ..... 417/212, 220, 219, 213; 418/30–31, 418/26
See application file for complete search history.

(56) References Cited

U.S. PATENT DOCUMENTS

| | | | | |
|---|---|---|---|---|
| 7,018,178 | B2 | 3/2006 | Hunter et al. | |
| 7,726,948 | B2 * | 6/2010 | Hunter et al. | 417/213 |
| 2001/0036412 | A1 * | 11/2001 | Konishi | 417/220 |
| 2003/0031567 | A1 | 2/2003 | Hunter et al. | |

FOREIGN PATENT DOCUMENTS

| | | | |
|---|---|---|---|
| KR | 10-2003-0063555 | A | 7/2003 |
| WO | WO2008/137037 | A1 | 11/2008 |

* cited by examiner

*Primary Examiner* — Charles Freay
*Assistant Examiner* — Christopher Bobish
(74) *Attorney, Agent, or Firm* — Warn Partners, P.C.

(57) ABSTRACT

The present invention is a variable displacement pump system for delivering precisely controlled oil flow and pressure, including a variable displacement pump having an inlet passage, an outlet passage, a first chamber and a second chamber for controlling the displacement of the variable displacement pump. The present invention also includes a fluid control device for receiving fluid from the outlet passage, and selectively delivering fluid to the second chamber. Fluid is delivered from the inlet passage to the outlet passage from the variable displacement pump, and fluid is also delivered from the outlet passage to the first chamber and the fluid control device. When fluid pressure is greater in the first chamber relative to the second chamber, the displacement of the variable displacement pump will decrease, and when fluid pressure is greater in the second chamber relative to the first chamber, the displacement of the variable displacement pump will increase.

29 Claims, 3 Drawing Sheets

HYDRAULIC PUMP WITH VARIABLE FLOW AND PRESSURE AND IMPROVED OPEN-LOOP ELECTRIC CONTROL

CROSS-REFERENCE TO RELATED APPLICATIONS

This application is a PCT International Application of U.S. Provisional Application No. 60/927,651, filed May 4, 2007. The disclosure of the above application is incorporated herein by reference.

FIELD OF THE INVENTION

The present invention relates to controlling the output of a variable flow pump. More specifically, the present invention relates to a control system for a variable oil pump used with an engine, with the control system used for controlling the output of the oil pump.

BACKGROUND OF THE INVENTION

Engines used in motor vehicles typically have a pump in some form which provides lubrication to the engine bearings, as well as other components of the engine. Typically, these oil pumps are driven directly or indirectly by the crankshaft of the engine, and do not have very complex pressure regulation systems. While these systems generally are sufficient, there are several disadvantages. Most notably, because of the simplicity of the pressure regulation system, control over the output of the oil pump and fluid delivery to the various engine parts is somewhat limited.

One example of this lack of control is that there are certain engine operating conditions where the maximum amount of oil flow is not needed for the various engine components. However, because of the lack of flexibility of control of the oil pump, the oil pressure may exceed what is needed under these various operating conditions, which leads to excessive power consumption by the oil pump, and reduced efficiency of the engine. This is mainly because the design of the oil pump is usually in such a manner that, under all engine operating conditions, the oil pump attempts to deliver higher levels of oil pressure and flow required for worst case conditions.

Accordingly, there exists a need for a method of control of a variable flow pump, by using an engine control unit which actuates a solenoid for either direct or indirect control of the oil pump.

SUMMARY OF THE INVENTION

The present invention is a variable displacement pump system for delivering precisely controlled oil flow and oil pressure, including a variable displacement pump having an inlet passage, an outlet passage, a first chamber for controlling the displacement of the variable displacement pump, and a second chamber for controlling the displacement of the variable displacement pump. The present invention also includes a fluid control device for receiving fluid from the outlet passage, and selectively delivering fluid to the second chamber.

Fluid is delivered from the inlet passage to the outlet passage from the variable displacement pump, and fluid is also delivered from the outlet passage to the first chamber and the fluid control device. When fluid pressure is greater in the first chamber relative to the second chamber, the displacement of the variable displacement pump will decrease, and when fluid pressure is greater in the second chamber relative to the first chamber, the displacement of the variable displacement pump will increase.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
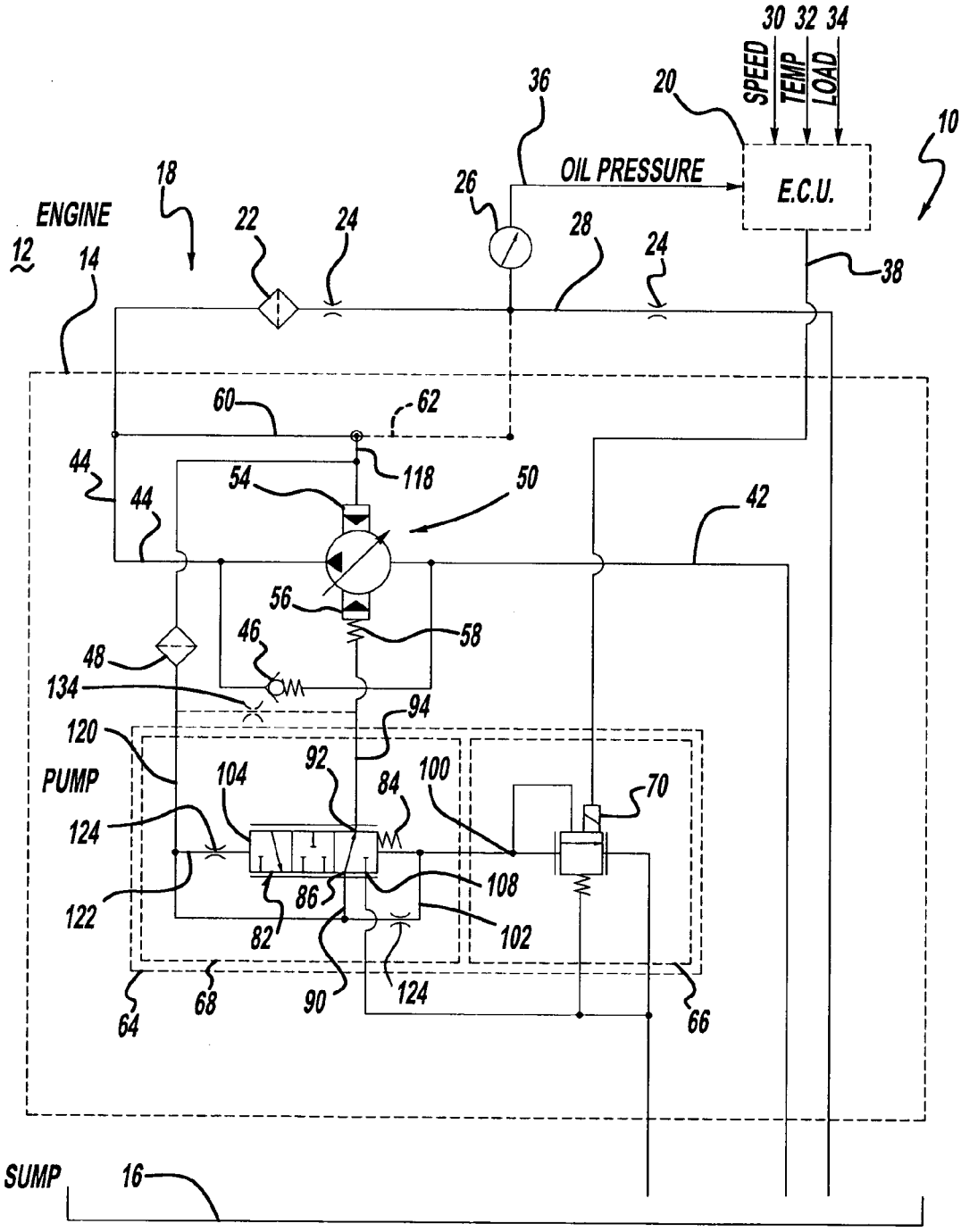
FIG. 1 is a schematic view of a system for controlling the flow and pressure of a pump, according to the present invention.

The following description of the preferred embodiment(s) is merely exemplary in nature and is in no way intended to limit the invention, its application, or uses.

Referring to the Figures generally, a system for pumping fluid according to the present invention is generally shown at 10. The system 10 has an engine side or an engine 12, a pump side or a variable displacement pump 14, and an oil sump 16. The system 10 is provided for controlling the oil pump 14 with either a variable displacement pump element or a variable output pump element. It should be appreciated that other types of pump systems can be used in the present invention, such as but not limited to other types of vane pumps, gear pumps, piston pumps, and/or the like.

In the system 10 of the present invention, there is at least a lubrication circuit, generally shown at 18, an engine control unit (i.e., ECU) or computer 20. The oil pump 14 draws oil from the oil sump 16 and delivers it at an elevated pressure to the lubrication circuit 18.

The lubrication circuit 18 includes an oil filter 22, and a variable pressure transducer 26. Fluid is delivered to the engine's crankshaft, bearings, connecting rods, and camshafts. While the oil filter 22 and the variable pressure transducer 26 are shown in this embodiment, other embodiments of the present invention may not include the oil filter 22, or the pressure transducer 26. More specifically, the pressure transducer 26 may be eliminated because the system 10 has the ability to operate as an open loop system. The lubrication circuit 18 restrictions are schematically shown by constrictions 24. The lubrication circuit 18 can also optionally contain items such as piston cooling jets, chain oilers, variable cam timing phasers, and cylinder de-activation systems, as are generally known in the art. The lubrication circuit 18 also delivers fluid to a main oil gallery 28, which is part of the engine 12.

The ECU 20 includes electrical inputs for the measured engine speed 30, engine temperature 32, and engine load, torque or throttle 34. The ECU 20 can also have, as shown in the present embodiment, an electrical input for the measured oil pressure 36 from the transducer 26. The ECU 20 also has an output 38 for transferring an electrical control signal that is used to control the oil pump 14.

The oil pump 14 also includes a housing 40 which contains an inlet or a suction passage 42, and an outlet or a discharge passage and manifold 44. The oil pump 14 also optionally includes a pressure relief valve 46 and/or an internal oil filter 48 for cleaning the discharge oil for use inside the oil pump 14. While the present embodiment includes the pressure relief valve 46 and the internal oil filter 48, these devices are not necessary for the operation of the present invention.

The oil pump 14 contains a variable flow pump element, generally shown at 50. The variable flow pump element 50 includes a displacement control pump element, such as an eccentric ring 52. The position of the eccentric ring 52 determines the theoretical flow rate discharged by the pump element 50 at a given drive speed. Two control chambers 54,56 are provided in the housing 40 on opposing sides of the eccentric ring 52. Both of control chambers 54,56 contain fluid of controlled pressure for the intended purpose of exerting a control force on an area of the eccentric ring 52. The first chamber, e.g., the decrease chamber 54, contains pressure applied to the eccentric ring 52 to decrease the flow rate of the variable flow pump element 50, and the second chamber, e.g., the increase chamber 56, contains pressure applied to the eccentric ring 52 to increase the flow rate of the variable flow pump element 50. Disposed within the eccentric ring 52 is a rotor 128 having a plurality of slots 130, each slot 130 receiving a vane 132. The rotor 128 rotates about an axis, and is driven by rotational power received from the crankshaft of the engine 12.

There is also a spring 58 positioned between the housing 40 and the eccentric ring 52 which applies a force to the eccentric ring 52 to bias the eccentric ring 52 toward maximum fluid pumping displacement of the variable flow pump element 50. Also included is at least one channel in the form of channel 60 and channel 62. The decrease chamber 54 is be supplied with oil pressure from either the oil pump discharge manifold 44 via channel 60 or, in an alternate embodiment, at some other point downstream in the lubrication circuit 18 (e.g., usually from the main oil gallery 28) via channel 62.

The oil pump 14 also contains a fluid control device in the form of a solenoid valve module 64 which includes a solenoid valve stage 66 and a pressure regulator valve stage 68. The solenoid valve module 64 is used for controlling the amount of fluid pressure in the increase chamber 56.

The solenoid valve stage 66 includes a solenoid 70, an armature spring 72, and a housing 74. The solenoid 70 includes a coil of electrical wire 76 and a ferrous armature 78, configured so that an electric current passing through the coil 76 generates an electromagnetic field which moves the armature against the compression spring 72 and opens the valve hole 80 in the housing 74, thereby allowing fluid to flow through it.

The pressure regulator valve stage 68 includes a spool 82, a spool spring 84, and an area defining a bore 86 (i.e., in housing 74) for radial containment of the spool 82. The spool 82 has an outer diameter with two annular grooves, a spool supply port 88 and a spool control port 92. The spool supply port 88 is in continuous fluid communication with a housing supply port 90, and the spool control port 92 is in continuous fluid communication with a housing control port 94. The spool supply port 88 is also in continuous fluid communication with a first fluid chamber 100 via a restrictive orifice hole 102. The spool 82 is positioned axially in bore 86 by the resultant force of the control pressure in fluid chamber 100, the spring 84, and the supply pressure in a second fluid chamber 104. The restrictive orifice hole 102 creates a pressure differential between the fluid chamber 104 and the fluid chamber 100, the function of which will be described later.

The channel 60 (or 62 in an alternate embodiment) is connected to a common inlet channel 118 which feeds into the decrease chamber 54. Connected to the inlet channel 118 is a pressure supply channel 120; in this embodiment, the oil filter 48 is included and is located in the pressure supply channel 120. Housing supply port 90 is supplied with oil pressure from the pressure supply channel 120 and, if included, the filter 48; the pressure supply channel 120 receives pressure from the channel 60 (or 62) via the inlet channel 118. The pressure supply channel 120 is connected to a channel 122, the channel 122 is connected to a port 106, and feeds fluid to the fluid chamber 104. The pressure supply channel 120 is also in fluid communication with the housing supply port 90. The lubrication circuit 18 also optionally includes another restrictive orifice 124 in which fluid flows through before flowing into through the port 106. The purpose of the restrictive orifice 124 is for damping the movement of the spool 82 by slowing down the flow of fluid through the port 106.

A change in the axial position of spool 82 will increase or decrease the amount of fluid communication between spool control port 92 and the housing supply port 90, and between the spool control port 92 and a housing drain port 108. This has the resultant effect of regulating the control pressure (e.g., see reference 98 in FIG. 3) in spool control port 92 and housing control port 94 to some level lower than the pressure in housing supply port 90 (e.g., see reference 96 in FIG. 3). The lower pressure level is determined by the spring rate and assembled length of spring 84 and the areas at the ends of the spool 82. The lower pressure level is supplied to the increase chamber 56 through housing control port 94 where it acts on the eccentric ring 52 along with the spring 58 to increase the flow rate of the variable flow pump element 50. The lower pressure level serves as a "reference pressure" for the eccentric ring 52, along with spring 58, so that if the pressure in the decrease chamber 54 exceeds the combined force of the pressure in the increase chamber 56 and the spring 58, the pressure in the decrease chamber 54 moves the eccentric ring 52 to reduce the pump flow, which will reduce the pressure in the decrease chamber 54 until it is in force equilibrium with the pressure in increase chamber 56 and the spring 58.

Conversely, when the pressure in the decrease chamber 54 is lower than the reference pressure, the pressure in the increase chamber 56 and the spring 58 will move the eccentric ring to increase the pump flow. The pressure regulator valve stage 68 is shown in accordance with one aspect of the present invention to have a total of three fluid communication ports, i.e., the spool supply port 88, the housing supply port 90 and the housing drain port 108.

Figure 2:
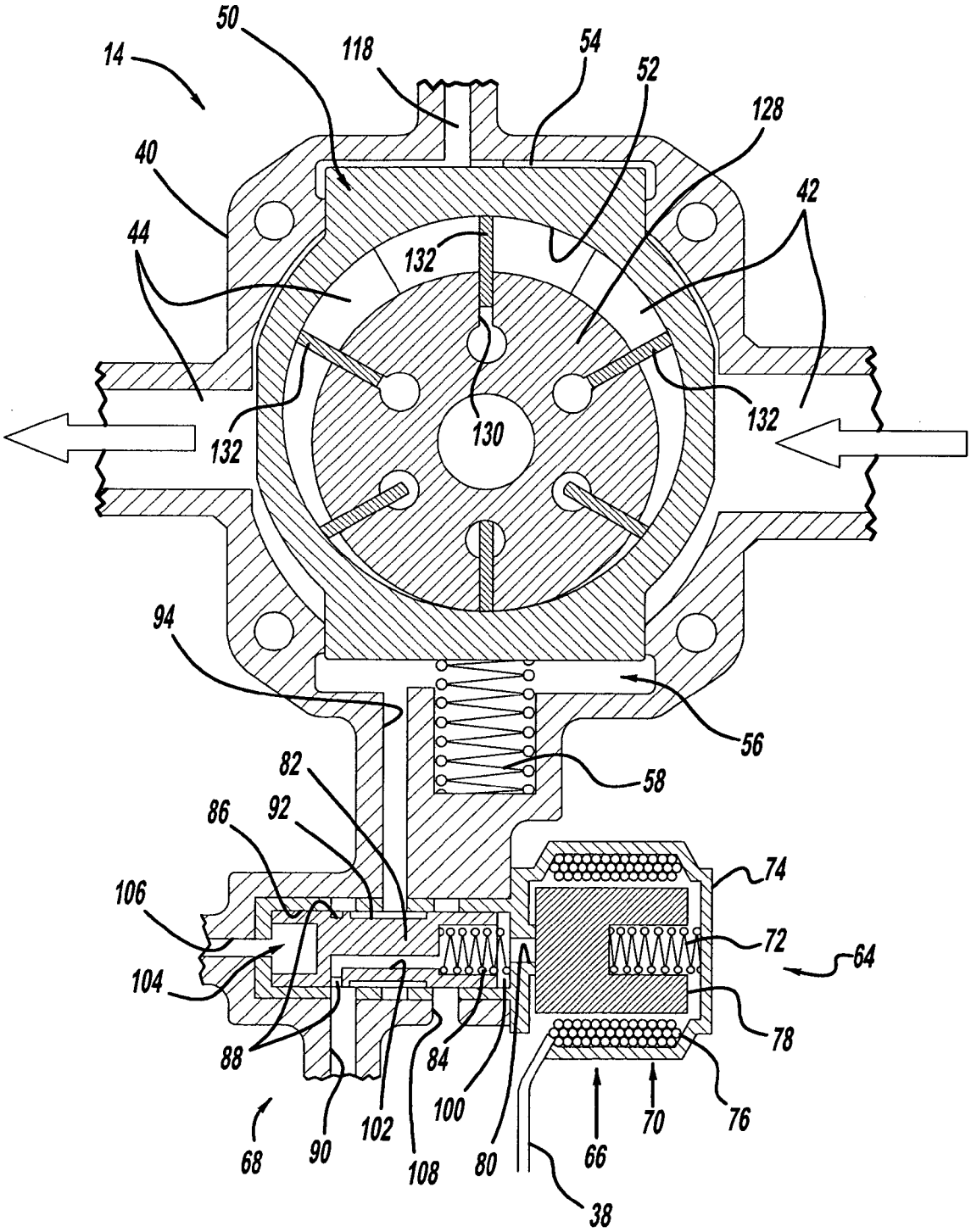
FIG. 2 is a section view of a pump used in a system for controlling the flow and pressure of a pump, according to the present invention.

During engine 12 start-up when there is low fluid pressure, the pump 14 is in the position as shown in FIG. 2, with the spring 58 biasing the pump 14 to have maximum displacement. Also during engine 12 start-up, and low fluid pressure, the spring 84 biases the spool 82 toward the left when looking at FIG. 2, and the spring 72 biases the armature 78 toward the left when looking at FIG. 2. Pressure then builds equally in the increase chamber 56 and the decrease chamber 54 as the pump 14 pumps fluid. When the eccentric ring 52 is in the position shown in FIG. 2, the maximum amount of fluid is being pumped by the rotor 128 and vanes 132. The vanes 132 slide into and out of the slots 130 as the rotor 128 rotates, and the space in between each of the vanes 132 expands and contracts, drawing in fluid from the suction passage 42, and forcing fluid into the discharge passage 44.

The amount of space in between each of the vanes 132 which expands and contracts will vary as the position of the eccentric ring 52 is changed in relation to the rotor 128. The vanes 132 are in sliding contact with the eccentric ring 52 at all times; the sliding contact between the vanes 132 and the eccentric ring 52 can be maintained by any conventional means, such as centrifugal force, oil pressure underneath the vanes 132, or a vane extension ring (not shown) which moves with the eccentric ring 52, and supports each of the vanes 132.

When the pressure is reduced in the increase chamber 56 and increased in the decrease chamber 54 such that the pressure in the decrease chamber 54 applies a greater amount of force to the eccentric ring 52 compared to the combined force applied to the eccentric ring 52 from the spring 58 and the pressure in the increase chamber 56, the eccentric ring 52 will move downwardly when looking at FIG. 2 to a position such that the amount of displacement is reduced. If enough pressure is in the decrease chamber 54, the displacement of the pump 14 will be substantially zero, and the space between the vanes 132 will not expand and contract, and no fluid is pumped. If the amount of fluid pressure in the decrease chamber 54 and the increase chamber 56 is equal, the spring 58 will bias the pump 14 to have maximum displacement. The position of the eccentric ring 52 can be positioned such that the displacement of the pump 14 can range from substantially zero to maximum displacement.

Figure 3:
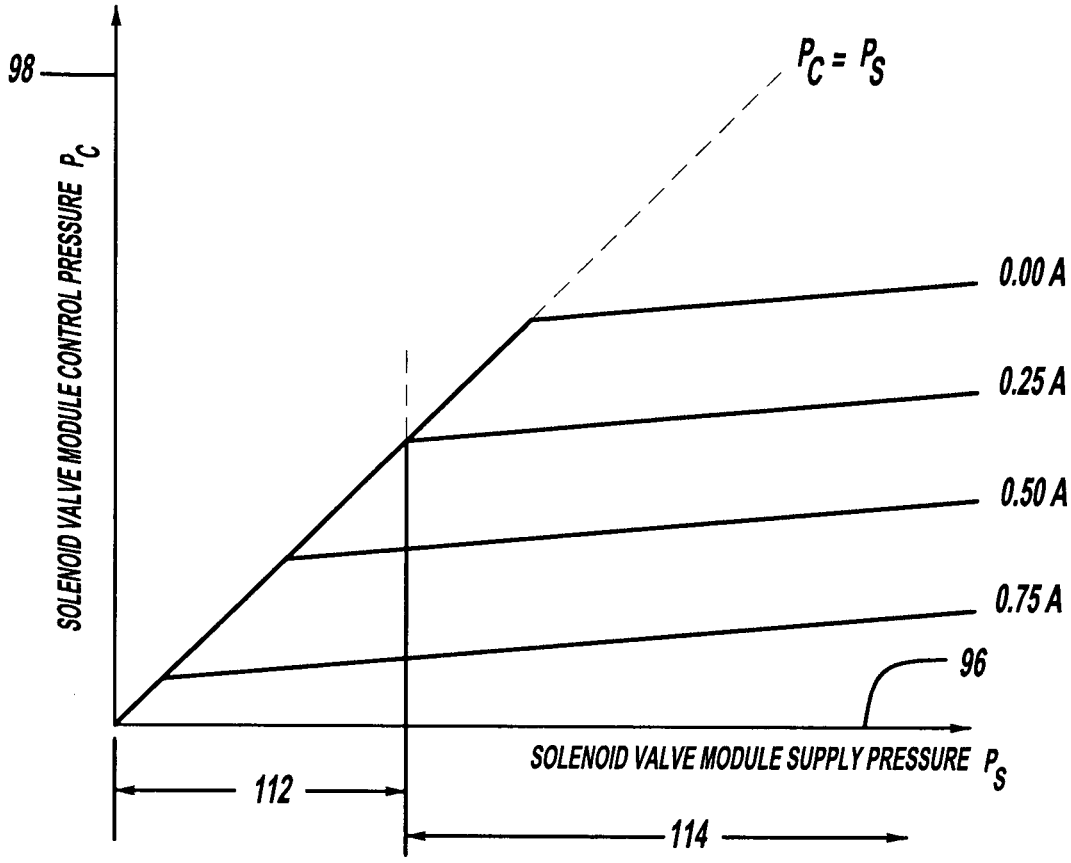
FIG. 3 is a graph demonstrating the performance characteristics of a solenoid valve module used in a system for controlling the flow and pressure of a pump, according to the present invention.

FIG. 3 graphically illustrates the solenoid valve control pressure 98 (e.g., in spool control port 92 and housing control port 94) on the vertical axis as a function of both the supply pressure 96 (e.g., in spool supply port 88 and housing supply port 90) on the horizontal axis and the current to the solenoid valve 66 through the ECU electrical output line/wire 38.

In accordance with one aspect of the present invention, the curves have two characteristic zones, e.g., the offset control pressure zone 112, and the variable control pressure zone 114. The transition from the offset control pressure zone 112 to the variable control pressure zone 114 occurs at decreasing supply pressure as the current to the solenoid valve 66 is increased.

In operation, the pump 14 begins at low supply pressure 96 (at start-up). As previously mentioned, at low supply pressure 96, the spring 84 holds the spool 82 to the left in dominance, when looking at FIG. 2, thereby reducing the amount of fluid communication between the spool control port 92 and the housing drain port 108 and increasing the amount of fluid communication between the spool control port 92 and the housing supply port 90, which will increase the pressure and volume of fluid in the increase chamber 56. The spring 72 will hold the armature 78 toward the left when looking at FIG. 2, and the spring 58 will hold the eccentric ring 52 in the position shown in FIG. 2, and the pump 14 will be at maximum displacement. The pump 14 will pump fluid, and pressure will build in fluid chamber 100 and fluid chamber 104. At this point, fluid will flow into the fluid chamber 104 from the port 106, as well as into the spool supply port 88 from the housing supply port 90. From the housing supply port 90, a portion of the fluid will flow through the spool supply port 88 and the restrictive orifice hole 102 into the fluid chamber 100 where pressure will begin to build, and another portion of the fluid will flow into the spool control port 92 from the housing supply port 90. The portion of fluid in the spool control port 92 will flow into the housing control port 94 and into the increase chamber 56.

Initially, as the supply pressure 96 increases in the fluid chamber 104 and the fluid chamber 100 simultaneously, the pressure of the fluid flowing into the fluid chamber 104 and the fluid chamber 100 is substantially equal. Therefore, as the supply pressure 96 continues to increase, the force from spring 84, together with the control pressure force in fluid chamber 100, e.g., communicated via restrictive orifice hole 102, overcomes the supply pressure force in fluid chamber 104 and holds the spool 82 to the left when looking at FIG. 2.

As the supply pressure 96 continues to increase, the pressure in fluid chamber 100 will also continue to increase, and the fluid pressure in fluid chamber 100 along with the force applied from the ferrous armature 78 will eventually overcome the spring 72 holding the solenoid armature 78 against the housing 74, thereby opening valve hole 80.

When the valve hole 80 is open, and there is a restricted fluid flow through the restrictive orifice hole 102, fluid pressure in fluid chamber 100 is no longer equal to, but is reduced in comparison to the supply pressure 96 at the spool supply port 88. This creates the pressure differential between the fluid chamber 100 and the fluid chamber 104. As the pressure in fluid chamber 100 continues to drop relative to the pressure in fluid chamber 104, the differential pressure acting on the spool 82 in fluid chamber 104 will eventually overcome the combined force applied to the spool 82 from the spring 84 and the pressure in fluid chamber 100, causing the spool 82 to move to the right when looking at FIG. 2, increasing the fluid communication between the spool control port 92 and the housing drain port 108, and reducing the fluid communication between the spool control port 92 and the housing supply port 90, reducing the pressure and fluid volume in the increase chamber 56.

The ECU 20 has the ability to selectively route current through the solenoid coil 76 via the electrical output 38. This results in an electromagnetic field, and biases the armature 78 to move against the spring 72. The bias of the armature 78 alone against the spring 72 does not move the armature 78; however, the force applied from the armature 78 to the spring 72 resulting from the electromagnetic field reduces the amount of pressure needed in the fluid chamber 100 to overcome the force from the spring 72 to move the armature 78 and open the valve hole 80, thereby reducing the pressure in fluid chamber 100, which causes the pressure regulator valve stage 68 and everything upstream of the pressure regulator valve stage 68 (i.e., the common inlet channel 118 and the pressure supply channel 120) to be reduced in pressure as well.

The current chosen is selected based on the desired operating conditions of the system 10. As the amount of current applied to the solenoid coil 76 increases, the amount of pressure needed in the fluid chamber 100 to overcome the force of the spring 72 decreases. The current applied to the solenoid coil 76 is either set to a constant value, or varied to regulate the pressure in fluid chamber 100, and therefore the position of the spool 82. The control pressure 98 is adjusted automatically by the system 10 to maintain the correct pressure in the increase chamber 56 to achieve the target pressure in the common inlet channel 118.

The oil pump 14 still functions without the ECU 20, because the solenoid valve module 64 performs some pressure regulation activity even without electrical power, as shown in the variable control pressure zone 114 in FIG. 3 at a current of zero Amperes. If no current is applied to the solenoid coil 76, the armature 78 still moves when enough pressure is built up in fluid chamber 100 to overcome the force of the spring 72. This allows the pressure in fluid chamber 100 to reach a maximum pressure prior to any movement of the armature 78, regardless of whether or not current is applied to the solenoid coil 76.

The oil pump 14 can be operated in an open loop control mode or a closed loop control mode. The oil pump 14 can be operated by the ECU 20 in an open loop control mode because the ECU 20 can be reasonably certain of the oil pressure in the lubrication circuit 18 as a function of current to the solenoid 70 through electrical output 38 from an internal "look up" table in the ECU 20, even without measuring the oil pressure through the transducer 26, because the system is regulating directly according to the feedback pressure in common inlet channel 118 and the pressure supply channel 120.

The oil pump 14 can also be operated by the ECU 20 in a closed loop control mode to actively control the oil pressure by adjusting its electrical signal to the solenoid 70 through electrical output 38 according to software logic control programmed into the ECU 20, and the oil pressure measured in the lubrication circuit 18 by transducer 26. The ECU 20, if desired, has the ability to anticipate increasing oil demand in the lubrication circuit 18. This is accomplished by simultaneously actuating the pump and an oil-consuming engine subsystem, such as variable cam timing or cylinder deactivation. The ECU 20, through the present invention, also has the capability of selectively activating certain pressure-sensitive engine subsystems, by selecting a higher or lower oil pressure for the lubrication circuit 18 depending on any known condition, including but not limited to the measured engine speed 30, engine temperature 32, and/or engine load 34.

Additionally, the oil pump 14 has the ability to be operated in a mixed control mode by combining elements of the previous three control modes. By way of a non-limiting example, it is useful to allow the oil pump 14 to regulate itself without ECU 20 control at conditions outside the range of normal parameters, and then to use open loop control to quickly achieve oil pressure near the desired value, and then use closed loop control to exactly achieve the desired oil pressure.

An alternate embodiment of the invention is shown in FIG. 1 where an added restriction line, shown in phantom at 134, allows fluid to flow directly from pressure supply channel 120 directly to housing control port 94. In this embodiment, the housing control port 94 no longer actively receives fluid from spool control port 92, and the solenoid valve module 64 is then used to control the fluid delivery solely from the housing control port 94 to the housing drain port 108. The spool 82 still operates in the same manner as the previous embodiment, with the exception that the housing control port 94 will no longer actively receive fluid from spool control port 92 after initial start-up of the engine.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for controlling the flow and pressure of a variable displacement pump, comprising:

a variable displacement pump having an inlet passage, and an outlet passage;

a first chamber for controlling the displacement of said variable displacement pump;

a second chamber for controlling the displacement of said variable displacement pump;

a fluid control device for receiving fluid from said outlet passage, and selectively delivering fluid to said second chamber, and fluid is delivered from said inlet passage to said outlet passage from said variable displacement pump, fluid is delivered from said outlet passage to said first chamber and said fluid control device, and when fluid pressure is greater in said first chamber relative to said second chamber, the displacement of said variable displacement pump will decrease, and when fluid pressure is greater in said second chamber relative to said first chamber, the displacement of said variable displacement pump will increase;

wherein said fluid control device includes a solenoid valve module having a pressure regulator valve stage including:

a spool disposed within a bore, said spool having a spool supply port and a spool control port;

a housing supply port in continuous fluid communication with said spool supply port and selectively in varying fluid communication with said spool control port, said housing supply port in fluid communication with and receives fluid from said outlet passage;

a housing control port in continuous fluid communication with said spool control port, and said second chamber;

a spool spring operably associated with said spool, said spool spring disposed within a first fluid chamber, said first fluid chamber in fluid communication with said spool supply port;

a second fluid chamber in fluid communication with, and receives fluid pressure from, said outlet passage; and a housing drain port selectively in varying fluid communication with said spool control port, and under low fluid pressure, said spool spring disposed in said first fluid chamber biases said spool such that said spool control port is in substantially reduced fluid communication with said housing drain port, and said spool supply port will receive fluid pressure from said housing supply port to deliver fluid pressure to said spool control port such that said spool control port will deliver fluid to said housing control port, said first fluid chamber will receive fluid pressure from said spool supply port, and said second fluid chamber will receive fluid from said outlet passage.

2. The system for controlling the flow and pressure of a variable displacement pump of claim 1, wherein said variable displacement pump is biased toward maximum displacement, and said fluid control device is biased to allow said outlet passage of said variable displacement pump to deliver fluid to said second chamber, and when fluid is delivered to said second chamber, the displacement of said variable displacement pump increases.

3. The system for controlling the flow and pressure of a variable displacement pump of claim 1, said fluid control device including a solenoid valve module having a solenoid valve stage comprising:

a solenoid having an armature spring operably associated with an armature, said armature operably associated with a valve hole of said fluid control device, and said armature spring biases said armature toward said valve hole, preventing fluid flow through said valve hole; and a coil surrounding said armature such that when a current is supplied to said coil, said armature will apply a force to said armature spring, causing the amount of fluid pressure needed to move said armature away from said valve hole to be reduced, and when the force applied from said armature to said armature spring along with fluid pressure in said valve hole is greater than the force applied to said armature from said armature spring, said armature will move away from said valve hole of said fluid control device, allowing fluid to pass through said valve hole.

4. The system for controlling the flow and pressure of a variable displacement pump of claim 3, further comprising fluid pressure to build in said valve hole which is greater than the force applied to said armature from said armature spring, said armature becomes displaced, allowing fluid to pass through said valve hole.

5. The system for controlling the flow and pressure of a variable displacement pump of claim 1, further comprising the fluid pressure in said second fluid chamber and said first fluid chamber to be substantially equal, and said spool spring biases said spool such that said spool control port is in reduced fluid communication with said housing drain port, and said spool supply port will receive fluid pressure from said housing supply port, and deliver fluid pressure to said spool control port such that said spool control port will deliver fluid to said housing control port, said first fluid chamber will receive fluid pressure from said spool supply port, and said second fluid chamber will receive fluid from said outlet passage.

6. The system for controlling the flow and pressure of a variable displacement pump of claim 5, further comprising the fluid pressure in said first fluid chamber is reduced such that the fluid pressure in said second fluid chamber applied to said spool is greater than the combined force of said spool spring and fluid pressure in said first fluid chamber, causing said spool to move in said bore such that said spool control port will be in reduced fluid communication with said housing supply port, and said spool control port will be in increased fluid communication with said housing drain port.

7. The system for controlling the flow and pressure of a variable displacement pump of claim 6, said outlet passage being in fluid communication with said housing control port.

8. The system for controlling the flow and pressure of a variable displacement pump of claim 1, said pump further comprising:

a displacement control pump element;

said first chamber further comprising a decrease chamber;

said second chamber further comprising an increase chamber;

a housing surrounding said displacement control pump element to form said increase chamber and said decrease chamber, said increase chamber operably associated with said fluid control device, said inlet passage and said outlet passage formed in said housing; and a spring disposed in said housing, said spring biases said displacement control pump element to a position to create a displacement of said variable displacement pump, and when said fluid control device provides fluid pressure to said increase chamber such that the pressure in said increase chamber and force applied from said spring disposed in said housing to said displacement control pump element is greater than the pressure in said decrease chamber applied to said displacement control pump element, the displacement of said variable displacement pump will increase.

9. The system for controlling the flow and pressure of a variable displacement pump of claim 8, wherein the displacement of said variable displacement pump will decrease when the pressure in said decrease chamber is greater than the combined pressure of the fluid pressure in said increase chamber and the force from said spring disposed in said housing applied to said displacement control element.

10. The system for controlling the flow and pressure of a variable displacement pump of claim 8, said displacement control pump element further comprising an eccentric ring.

11. The system for controlling the flow and pressure of a variable displacement pump of claim 8, further comprising:

a rotor disposed within said displacement control pump element; and a plurality of vanes disposed in a plurality of corresponding slots, said plurality of corresponding slots formed in said rotor, and said plurality of vanes are in sliding contact with said displacement control pump element such that space is created between each of said plurality of vanes, said rotor, and said displacement control element such that when the displacement of said variable displacement pump is greater than zero, said displacement control pump element will be positioned such that the space between each of said plurality of vanes will expand and contract as said rotor rotates, causing fluid to be pumped from said inlet passage to said outlet passage.

12. The system for controlling the flow and pressure of a variable displacement pump of claim 1, said lubrication circuit further comprising:

an engine which includes a lubrication circuit, said lubrication circuit including:

a main oil gallery operably associated with said variable displacement pump;

at least one channel in fluid communication with said main oil gallery for facilitating fluid delivery to said variable displacement pump for changing the volume of fluid pumped by said variable displacement pump;

said inlet passage further comprising a suction passage in fluid communication with a sump, where fluid in said sump is pumped by said variable displacement pump;

said outlet passage further comprising a discharge passage where said fluid is discharged by said variable displacement pump;

a pressure supply channel operably associated with said at least one channel for delivering fluid from said at least one channel to said fluid control device; and wherein said variable displacement pump draws fluid from said sump into said suction passage, and pumps fluid out of said discharge passage, through said main oil gallery, said at least one channel, and said pressure supply channel.

13. A system for controlling the delivery of fluid and fluid pressure through a pump, comprising:

an engine which includes a lubrication circuit;

a variable displacement pump, said variable displacement pump having a suction passage, a discharge passage, and a displacement control pump element, said variable displacement pump operably associated with said lubrication circuit;

a solenoid valve module for controlling the amount of fluid pumped by said variable displacement pump, and said solenoid valve module receives fluid from said variable displacement pump to control the position of said displacement control pump element in said variable displacement pump, thereby controlling the amount of fluid pumped by said variable displacement pump through said lubrication circuit; and wherein said pressure regulator valve stage further including:

a bore for receiving a spool, said spool having a spool supply port in fluid communication with a housing supply port, and a spool control port in fluid communication with a housing control port, said housing control port in fluid communication with said variable displacement pump;

a spool spring operably disposed within a first fluid chamber, said first fluid chamber in fluid communication with said spool supply port, a portion of said first fluid chamber being formed by a portion of said spool;

a second fluid chamber in fluid communication with said discharge passage, a portion of said second fluid chamber formed by a portion of said spool;

a housing drain port selectively in varying fluid communication with said spool control port;

when said first fluid chamber and said second fluid chamber are under low fluid pressure, said spool spring positions said spool in said bore such that said spool control port has reduced fluid communication with said housing drain port, and said spool supply port receives fluid pressure from said housing supply port, thereby delivering fluid to said spool control port; and when fluid pressure builds in said second fluid chamber and fluid pressure is reduced in said first fluid chamber such that fluid pressure in said second fluid chamber is greater than the combined force of the fluid pressure in said first fluid chamber and the force applied to said spool from said spool spring, said spool will move in said bore such that said spool control port is in reduced fluid communication with said housing supply port or said spool supply port, and said spool control port is in increased fluid communication with said housing drain port.

14. The system for controlling the delivery of fluid and fluid pressure through a pump of claim 13, said solenoid valve module further comprising a solenoid valve stage and a pressure regulator valve stage.

15. The system for controlling the delivery of fluid and fluid pressure through a pump of claim 14, said solenoid valve stage further comprising:

an armature surrounded by a coil, said armature receiving pressure from an armature spring, said armature spring biasing said armature to prevent fluid from flowing through a valve hole; and when a current is applied to said coil, said, armature will apply an electromagnetic force to said armature spring, reducing the amount of fluid pressure needed in said valve hole to move said armature away from said valve hole, and when the fluid pressure in said valve hole combined with the electromagnetic force from said armature applied to said armature spring is greater than the amount of force applied to said armature from said armature spring, said armature will move away from said valve hole, allowing fluid to flow through said valve hole, relieving pressure in said pressure regulator valve stage.

16. The system for controlling the delivery of fluid and fluid pressure through a pump of claim 15, further comprising fluid pressure in said pressure regulator valve stage applies force to said armature which is greater than the force applied to said armature from said armature spring, thereby causing said armature to move away from said valve hole and allow fluid to flow through said valve hole, reducing pressure in said pressure regulator valve stage.

17. The system for controlling the delivery of fluid and fluid pressure through a pump of claim 13, further comprising when fluid pressure in said first fluid chamber and the fluid pressure in said second fluid chamber are equal, said spool spring will bias said spool such that said spool control port is in reduced fluid communication with said housing drain port, and said spool supply port receives fluid pressure from said housing supply port, thereby delivering fluid to said spool control port.

18. The system for controlling the delivery of fluid and fluid pressure through a pump of claim 13, further comprising said discharge passage to be in fluid communication with said housing supply port.

19. The system for controlling the delivery of fluid and fluid pressure through a pump of claim 13, said pump further comprising:

said displacement control pump element further comprising an eccentric ring;

a housing surrounding said eccentric ring to form an increase chamber and a decrease chamber, said increase chamber operably associated with said solenoid valve module, and said decrease chamber operably associated with said lubrication circuit, said suction passage and said discharge passage disposed within said housing;

a rotor disposed within said eccentric ring, said rotor having a series of slots;

a series of vanes, each of said series of vanes slidably disposed within a respective one of said series of slots, said series of vanes being in sliding contact with said eccentric ring such that space is created between each of said series of vanes, said rotor, and said eccentric ring;

said solenoid valve module selectively supplies fluid to said increase chamber; and a spring disposed within said housing for biasing said eccentric ring in a direction such that said variable displacement pump will have a displacement greater than zero, and as said solenoid valve module delivers fluid to said increase chamber, said fluid pressure in said increase chamber and force applied to said eccentric ring from said spring will increase the displacement of said variable displacement pump, and when fluid pressure in said decrease chamber is greater than the fluid pressure and spring force applied to said eccentric ring in said increase chamber, the displacement of said variable displacement pump will be decreased.

20. The system for controlling the delivery of fluid and fluid pressure through a pump of claim 19, when the displacement of said variable displacement pump is greater than zero, said series of vanes will move into and out of said series of slots as said rotor rotates, causing the space between each of said series of vanes to expand and contract, thereby creating a pumping action, and when the displacement of said variable displacement pump is substantially zero, the space between said series of vanes will remain substantially constant, and said variable displacement pump will not pump fluid.

21. The system for controlling the delivery of fluid and fluid pressure through a pump of claim 13, said lubrication circuit further comprising:

a sump which retains fluid, and said suction passage draws fluid from said sump;

a main oil gallery for receiving fluid from said discharge passage, said main oil gallery operably associated with said engine;

at least one fluid channel in fluid communication with said main oil gallery for delivering fluid to said pump;

a pressure supply channel in fluid communication with said at least one fluid channel, and said solenoid valve module; and fluid discharged from said pump will be delivered from said at least one fluid channel to said solenoid valve module through said pressure supply channel, and when said pump is pumping fluid, said suction passage will draw in fluid from said sump, and said discharge passage will deliver fluid to said main oil gallery.

22. A system which facilitates the volume of fluid delivery through a pump system, comprising:

an engine;

a variable displacement pump, said variable displacement pump having a housing, said housing having a suction passage and a discharge passage;

an eccentric ring disposed within said housing, said housing surrounding said eccentric ring to form an increase chamber and a decrease chamber;

a pressure regulator valve stage for changing the position of said eccentric ring in said housing;

a solenoid valve stage for altering the flow of fluid through said pressure regulator valve stage;

a lubrication circuit for facilitating the flow of fluid between said engine and said variable displacement pump, said lubrication circuit for receiving fluid from said discharge passage;

said lubrication circuit delivers fluid to said pressure regulator valve stage to build fluid pressure in said pressure regulator valve stage, said pressure regulator valve stage will deliver fluid pressure to said increase chamber, to change the position of said eccentric ring in said housing and thereby changing the amount of fluid pumped by said pump, and said solenoid valve stage changes the fluid pressure in said pressure regulator valve stage, varying the amount of fluid pressure delivered to said increase chamber;

wherein said pressure regulator valve stage further comprising:

a spool having a spool supply port and a spool control port, said spool control port selectively in varying fluid communication with a housing supply port;

said housing supply port in continuous fluid communication with said spool supply port;

a housing control port in continuous fluid communication with said spool control port;

a bore for receiving said spool;

a first fluid chamber formed between an end of said spool and said bore, which receives fluid from said spool supply port;

a second fluid chamber formed between and end of said spool and said bore, which receives fluid pressure from said variable displacement pump;

a housing drain port selectively in varying fluid communication with said spool control port; and a spool spring disposed within said first fluid chamber for biasing said spool such that said spool control port is in increased fluid communication with said housing supply port when said pressure regulator valve stage is under low pressure, and said housing supply port will deliver fluid pressure to said spool supply port and to said spool control port, and said first fluid chamber will receive fluid pressure from said spool supply port.

23. The system which facilitates the volume of fluid delivery through a pump system of claim 22, said pump further comprising:

a rotor having a series of slots, said rotor driven by a device having rotary power to cause said rotor to rotate within said eccentric ring;

a series of vanes, each one of said series of vanes slidably disposed within a distinct one of said series of slots, said series of vanes in sliding contact with said eccentric ring such that a space is formed between each of said series of vanes, said rotor, and said eccentric ring;

a spring disposed in said housing, and in contact with said eccentric ring;

when the combined force applied to said eccentric ring from said spring disposed in said housing and the pressure in said increase chamber is greater than the force applied to said eccentric ring from said decrease chamber, the displacement of said variable displacement pump will be increased, and said eccentric ring will be in a position such that said series of vanes will slide further into and out of said series of slots and the space between each of said series of vanes expands and contracts a greater amount, drawing in an increased amount fluid into said suction passage and discharging fluid out of said discharge passage; and when the combined force applied to said eccentric ring from said spring and the pressure in said increase chamber is less than the force applied to said eccentric ring from said decrease chamber, said eccentric ring will be in a position relative to said rotor such that the displacement of said variable displacement pump is decreased, causing the amount of expansion and contraction of the space between each of said series of vanes to be reduced, reducing the amount of fluid drawn into said suction passage.

24. The system which facilitates the volume of fluid delivery through a pump system of claim 22, further comprising fluid pressure in said first fluid chamber to be relieved, and said second fluid chamber receives fluid from said lubrication circuit, building pressure in said second fluid chamber such that the force applied to said spool from said spool spring is overcome, and said spool will move in said bore, thereby reducing fluid communication between said housing supply port and said spool control port, causing said spool control port to be in increased fluid communication with said housing drain port.

25. The system which facilitates the volume of fluid delivery through a pump system of claim 22, when fluid pressure in said second fluid chamber applied to said spool is equal to the fluid pressure in said first fluid chamber applied to said spool, said spool spring will bias said spool in said bore such that said housing supply port will deliver fluid to said spool supply port and said spool control port.

26. The system which facilitates the volume of fluid delivery through a pump system of claim 22, where said discharge passage is in fluid communication with said housing control port.

27. The system which facilitates the volume of fluid delivery through a pump system of claim 22, said solenoid valve stage further comprising:

an armature surrounded by a coil, said armature biased by an armature spring to maintain fluid pressure in said pressure regulator valve stage when said pressure regulator valve stage creates fluid pressure in said increase chamber;

an electric current is applied to said coil, thereby causing said armature to apply a force to said armature spring, reducing the amount of fluid pressure needed from said pressure regulator valve stage to move said armature; and when the combined force of said armature applied to said armature spring when electric current is applied to said coil along with fluid pressure in said pressure regulator valve stage is greater than the force applied to said armature from said armature spring, said armature will move in a direction to overcome the force applied by said armature spring, relieving a portion of fluid pressure in said pressure regulator valve stage.

28. The system which facilitates the volume of fluid delivery through a pump system of claim 27, further comprising said armature will move in a direction to overcome the force applied by said armature spring, relieving a portion of fluid pressure in said pressure regulator valve stage when fluid pressure in said pressure regulator valve stage is greater than the force applied to said armature from said armature spring.

29. The system which facilitates the volume of fluid delivery through a pump system of claim 22, said lubrication circuit further comprising:

a main oil gallery operably associated with said engine;

at least one channel in fluid communication with said decrease chamber, said discharge passage, and said main oil gallery;

a pressure supply channel in fluid communication with said at least one channel and said pressure regulator valve stage;

a sump in fluid communication with said suction passage; and said fluid in said at least one channel will flow into said decrease chamber of said pump and said pressure supply channel, and said pressure supply channel will deliver fluid into said pressure regulator valve stage.

* * * * *

UNITED STATES PATENT AND TRADEMARK OFFICE

CERTIFICATE OF CORRECTION

PATENT NO. : 8,512,006 B2
APPLICATION NO. : 12/597790
DATED : August 20, 2013
INVENTOR(S) : Douglas G. Hunter It is certified that error appears in the above-identified patent and that said Letters Patent is hereby corrected as shown below:

Title Page, Item (73) Assignee: "BorgWarner Inc." should be --SLW Automotive Inc.--

Signed and Sealed this
Eighteenth Day of March, 2014

Michelle K. Lee

Michelle K. Lee
*Deputy Director of the United States Patent and Trademark Office*